United States Patent [19]

Umiastowski

[11] 4,056,924

[45] Nov. 8, 1977

[54] YARN-TWISTING METHOD AND APPARATUS

[76] Inventor: John Umiastowski, 127 Sunnyside Place, Dollard des Ormeaux, Quebec, Canada

[21] Appl. No.: 562,113

[22] Filed: Mar. 26, 1975

[30] Foreign Application Priority Data

Mar. 29, 1974 Canada ..... 196403

[51] Int. Cl.[2] ..... D02G 3/36; D02G 3/34; D02G 3/40

[52] U.S. Cl. ..... 57/5; 57/51.6; 57/160; 427/174; 427/180

[58] Field of Search ..... 57/3, 5, 6, 7, 36, 144, 57/51, 160, 51.6; 427/174, 175, 180, 184, 370

[56] References Cited

U.S. PATENT DOCUMENTS

| | | | |
|---|---|---|---|
| 1,990,337 | 2/1935 | Lewis et al. | 57/5 X |
| 2,131,598 | 9/1938 | Obermaier | 57/5 |
| 2,411,559 | 11/1946 | Sonin et al. | 57/5 X |
| 3,367,095 | 2/1968 | Field, Jr. | 57/5 |
| 3,439,491 | 4/1969 | Scruggs | 57/160 |
| 3,445,993 | 5/1969 | Vorisek | 57/6 |
| 3,696,600 | 10/1972 | Mayer, Jr. et al. | 57/5 |
| 3,802,174 | 4/1974 | Landwehrkamp et al. | 57/5 |
| 3,835,638 | 9/1974 | Mayer, Jr. et al. | 57/160 X |
| 3,845,611 | 11/1974 | Senturk et al. | 57/5 |

*Primary Examiner*—John Petrakes
*Attorney, Agent, or Firm*—Steinberg & Blake

[57] ABSTRACT

Method and apparatus for manufacturing yarn. The yarn has a flexible core at least part of which is twisted in a given direction while surface fibers are carried by the core at least at the twisted part thereof and are helically wound onto the exterior surface of the core in a direction opposite from the direction of twist thereof where the surface fibers are located. The yarn core initially has the fibers projecting laterally therefrom, and then the yarn core is false twisted while the fibers are helically wound into engagement with the exterior surface of the core when the initial twist is introduced into the same during false twisting with the helical winding of the fibers being in a direction opposite to the direction of the twist introduced into the core by false twisting thereof. The false twisting of the core is brought about by a simple rotary member which surrounds the core and is rotated with respect thereto at a speed sufficiently great to provide substantial slippage between the rotary member and the core, this rotary member having an end surface which engages the fibers and winds them helically against the exterior surface of the core during longitudinal feeding of the latter through the rotary member, with this action on the fibers resulting in the false twisting of the core.

12 Claims, 2 Drawing Figures

YARN-TWISTING METHOD AND APPARATUS

BACKGROUND OF THE INVENTION

The present invention relates to a method and apparatus for manufacturing yarn.

The yarn of the invention may be spun from discontinuous filaments. Thus, with the present invention multifilament strands may be drawn, such multifilament strands being in the form of sliver, roving, or other suitable forms which are well known, and a twisting element similar to a conventional false twister acts on the fibrous strands so as to consolidate them into a yarn having a structure composed, for example, of a core of essentially parallel fibers which are alternately twisted in different directions at different parts of the core with these fibers being held together in twisted condition at certain parts of the core by surface fibers which are uniformly helically wound at the exterior surface of the yarn core.

In conventional ring spinning as well as recently used open-end spinning it is required that the yarn fibers be twisted in the same direction, so that it is necessary with such procedures that one end of the yarn must be continuously rotated during spinning of the yarn. This requirement places an exceedingly great limitation on the linear speed of production inasmuch as for the purpose of introducing typically 10 turns of twist per inch of yarn at a linear operating speed of, for example, 3,000 inches per minute, a rotary speed for this one end of the yarn on the order of 10 times 3,000, or 30,000 revolutions per minute is required. It is, however, well known in the art that ring spinning procedures typically cannot exceed speeds of 20,000 revolutions per minute. Although with open-end spinning machine rotors it is possible to exceed speeds of 50,000 revolutions per minute, the twisting efficiency an open-end spinning machine decreases rapidly with increasing rotary speeds while the power consumed for driving the rotor increases rapidly to uneconomical levels. Therefore, both of these conventional procedures have serious obstacles with respect to improving production speed.

Of course, it is highly desirable to be able to produce yarns according to procedures which do not suffer from these drawbacks. Various procedures have already been proposed and some of them do indeed claim the advantage of significantly higher production speeds, as compared to conventional ring or open-end processes. However, these other types of procedures suffer from other disadvantages ranging from requirements of adhesives to hold the fibers together to undesirably low yarn strengths.

SUMMARY OF THE INVENTION

It is accordingly a primary object of the present invention to provide a method and apparatus for manufacturing yarn, which will avoid the above drawbacks enabling an exceedingly strong highly desirable yarn to be achieved with exceedingly high speeds of production.

Furthermore, it is an object of the present invention to provide a method and apparatus for manufacturing yarn, according to which it is possible to achieve a yarn which is of relatively high strength.

Furthermore, it is an object of the present invention to provide a method and apparatus which is capable of producing a yarn which has a considerable degree of liveliness.

Furthermore, it is an object of the present invention to provide a method and apparatus which are characterized by extreme simplicity enabling high production speeds to be achieved in a completely reliable manner.

Moreover, it is an object of the present invention to provide a method and apparatus capable of operating with almost any type of material or combinations thereof so that the yarn of the present invention can be given any desired properties not only as a result of the actions produced by the method and apparatus of the invention but also as a result of the materials or combinations of different materials used in the fibers and/or filaments which make up the yarn.

In accordance with the method of the invention the yarn is produced by, for example, drawing a strand of fibers as in conventional direct spinning and then depositing, approximately at a right angle, on the drafted fibrous strand a discontinuous stream of additional free staple fibers in order to obtain in this way a composite structure of fibers loosely attached to the surface of the fibrous strand. This composite structure is fed under suitably controlled tension through the inside of a hollow rotating cylindrical element which is referred to below as a twister. The twister serves to impart twists to the composite structure which is then linearly and continuously wound up by way of a conventional surface winder or any other means suitable for the purpose of collecting the yarn of the invention.

According to one of the features of the present invention, the twister used to impart the twist closely resembles a conventional pin-type false twister element, the primary difference between the latter conventional element and the twister of the invention residing in the fact that the cross-pin of the conventional twister element has been removed so that the twister of the invention is a tubular member having an unobstructed interior space. This twister of the invention preferably is capable of rotating at speeds up to or exceeding 1,000,000 revolutions per minute. The yarn passes through the interior of the twister while the latter is rotated and the inside diameter of the twister through which the yarn passes preferably should be from 2 to 5 times the average diameter of the yarn but this diameter could be as small as 1.5 times or as large as 10 times the yarn diameter, or more. The twister has an upstream annular end surface toward which the yarn is fed, and this annular surface of the yarn at the entrance end of the twister preferably is in the form of a roughened surface so as to enhance the twisting of the loose surface fibers about the core. The additonal staple fibers are delivered to the core by a depositing means for depositing these fibers thereon, this depositing means preferably comprising a conventional lickerin fiber-opening device, or a plurality of such devices may be used, so that by way of these devices fibers are opened and directed toward the drawn fibrous strand. However, other alternate depositing means may be used for delivery of the staple fibers, such as, for example, high-speed drawing rollers, or any other suitable means for the purpose of the present invention and known in the art. Similarly, although it is preferable and more economical to provide a drawn strand of fibers directly from roving, sliver, or tow, it is also possible to provide the yarn core from a continuous monofilament yarn or a multifilament strand could be used instead of the drawn strand of fibers or in conjunction therewith.

BRIEF DESCRIPTION OF DRAWINGS

The invention is illustrated by way of example in the accompanying drawings which form part of this application and in which.

DESCRIPTION OF PREFERRED EMBODIMENTS

Figure 1:
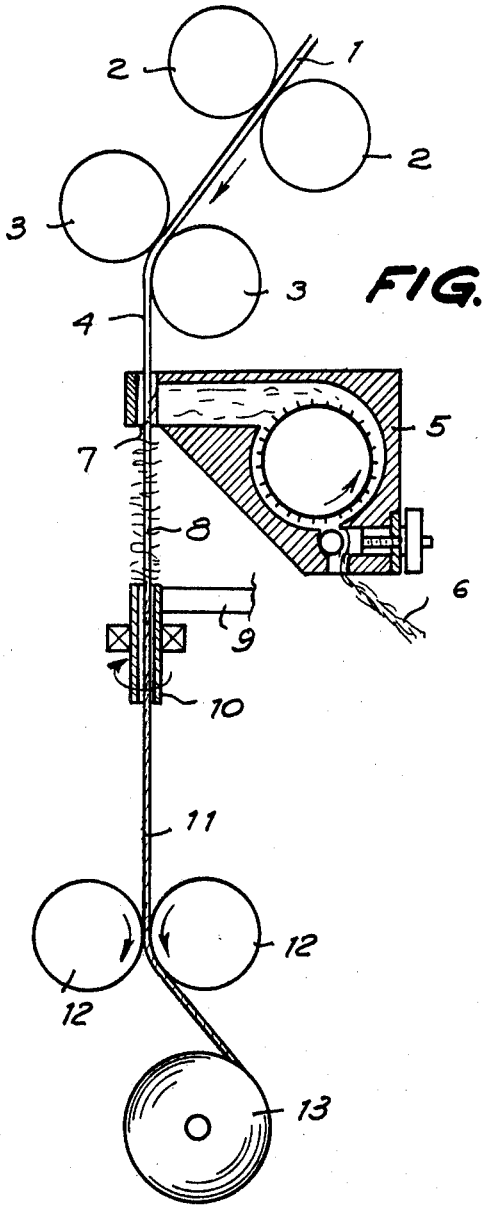
FIG. 1 is a schematic partly sectional elevation of one suitable apparatus according to the invention for performing the method of the invention in order to achieve the yarn of the invention.

Referring now to FIG. 1, there is shown at the upper part thereof a fiber drawing means formed by the pairs of rollers 2 and 3. As is well known the rollers 3 rotate at a speed somewhat greater than the rollers 2 for the purpose of drawing the sliver 1 which is schematically illustrated in FIG. 1 travelling from the drawing rollers 2 toward the drawing rollers 3.

The yarn is fed along a predetermined path coinciding with the axis of the yarn by way of a feed means which includes the pair of feed rolls 12 which act on the yarn so as to pull the yarn with a predetermined controlled tension from the drawing rollers 3 toward the feed rolls 12.

The yarn is this way fed along a predetermined path extending through a rotary means which surrounds this path as well as the yarn fed therealong by the feed means 12, and this rotary means takes the form of the illustrated twister 10 which is acted upon by a rotating means formed in part by the belt 9 so that the twister 10 can be rotated at high speed.

Upstream of the rotary means 10, considered in the direction of travel of the yarn from the rollers 3 toward the rollers 12, is a depositing means for depositing fibers on the exterior surface of the drawn sliver. This depositing means takes the form of a lickerin device 5 which operates to supply additional staple fibers to the drawn sliver 4 approximately at the location 7 between the drawing rollers 3 and the twister 10. Sliver 6 is supplied to the lickerin device 5 which acts in a known way to separate the fibers of the sliver 6 and to direct them in open, separated condition to the surface of the sliver 4 to which these additional staple fibers cling.

In this way, downstream of the location 7 the yarn of the invention has the composite structure 8 of a core, in the form of fibrous drawn sliver, for example, from which additional fibers laterally extend, these additional fibers of course being provided at the exterior surface of the core by way of the depositing means 5. This composite fiber structure 8 travels through the twister 10 and is continuously advanced by suitable yarn-pulling rollers 12 which serve to impart positive and controlled tension to the yarn.

Subsequent to the feed means 12 the yarn 11 of the invention is wound by a suitable winding means which includes the illustrated collecting roll 13 which is rotated about its axis in a known way while the completed yarn 11 of the invention is wound thereon.

The above-described apparatus of the invention operates in the following manner according to the method of the invention:

The rotary means formed by the twister 10 imparts false twist to the yarn passing through the twister 10 and as a result the drawn sliver 4 rotates in the direction illustrated by the curved arrow in FIG. 1. This rotating sliver is capable of collecting the additional staple fibers provided by the lickerin device 5 and these additional staple fibers remain loosely attached to the drawn sliver 4 as the drawn sliver advances to the twister 10. Thus, the composite fiber structure 8 has many free fiber ends projecting laterally from the surface of the core where they are held more or less at right angles to the yarn axis, with these additional staple fibers projecting laterally from the core in part as a result of centrifugal force of rotation.

It is important that the twister 10 rotate faster than the composite fiber structure 8 which enters into the twister so that there will be a substantial slippage between the twister and the composite fiber structure.

As was indicated above, the upstream annular end surface at the entrance end of the rotary means formed by the twister 10 is roughened or otherwise treated so as to have a relatively high coefficient of friction with respect to the fibers which project laterally from the yarn core. As a result, when the fiber ends of the structure 8 come into contact with this end surface of the twister 10, the fiber ends become twisted or helically wound around the core of the fibrous structure, this core in the illustrated example consisting primarily of drawn sliver 4, and the direction of helical winding of the fibers is opposite to the direction of twist imparted to the drafted sliver 4. It is to be noted that the false twist is imparted to the core by way of the action of the rotary means 10 on the fibers projecting from the core. In other words the rotary means 10, which, as shown in the drawing, has an uninterrupted inner surface of constant diameter, acts on these fibers to place them under a certain tension while they are helically wound along the core and are displaced at least partly into engagement with the exterior surface thereof, and it is this pulling of the fibers during the helical winding thereof which results in false twisting of the core itself with the initial twist in the core which is introduced during the false twisting being in an opposite direction to the helical winding of the fibers.

In accordance with the false-twist principle, at the exit end of the twister 10 the twist initially introduced into the drawn sliver 4 is removed and this action causes the helically wound surface fibers at the exterior of the core to be tightened along the surface of the core as the latter is released to tend to untwist itself, so that in this way complete twist removal is prevented in the core at those regions thereof where there is an abundance of the helically wound surface fibers. However, in those regions of the core where there is a lack of surface fibers or where the surface fibers are only situated in relatively small numbers or are not sufficiently tightly twisted for any reason, the core will undergo twist reversal so that at parts of the core where there are no surface fibers, for example, the twist of the yarn will be opposite to the twist which is retained therein by the surface fibers.

Figure 2:
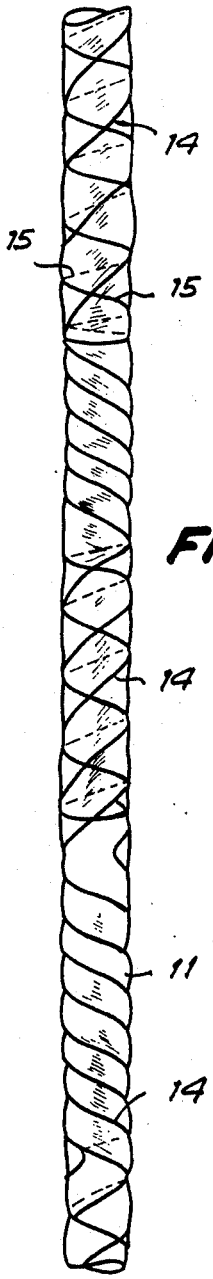
FIG. 2 is a fragmentary elevation showing one possible example of yarn manufactured by the method and apparatus of the invention at an enlarged scale as compared to the actual yarn.

Referring now to FIG. 2 which shows part of a yarn 11 manufactured according to the method and apparatus of the invention, it will be seen that at the upper portion of FIG. 2 there are surface fibers 15 helically wound against the exterior surface of the core 14. As is apparent from the upper portion of FIG. 2 the direction of twist of the core is opposite from the direction of helical winding of the surface yarns 15.

Just below this upper portion of FIG. 2 where the surface yarns 15 are illustrated there is a portion of the yarn 11 where the core 14 has no surface fibers and it will be seen that this part of the core 14 is twisted in the same direction as the helically wound fibers 15, which is to say in an opposite direction from the directon of twist at that part of the core 14 where the fibers 15 are located. A further region of the yarn 11 where there are no surface fibers is shown just above the lowermost part of FIG. 2, while between the latter region and the upper region where there are no surface fibers FIG. 2 illustrates an additional intermediate region where there are surface fibers 15 retaining in the yarn 14 the direction of twist which is opposite to the direction of twist where there are no surface fibers in FIG. 2.

Thus, in accordance with the present invention it is possible to provide a highly productive and efficient method for continuously spinning yarn in such a way as to avoid the drawbacks of conventional methods. The yarn can be produced according to the method of the invention at unusually high speeds while also being capable of producing a wide range of yarn counts, without the use of true twist or adhesives. Moreover, with the method and apparatus of the invention it is possible to achieve yarns in many different forms.

Thus, it is apparent that the present invention is based upon the premise that not all fibers in a yarn need be twisted in the same direction in order to lend strength to the yarn. It has been found that if some twist is initially inserted in a strand of essentially parallel but discontinuous fibers with this strand having a multitude of free fiber ends projecting from the core thereof, and if these free fiber ends are then twisted around the strand core in the direction opposite to the direction of twist inserted into the strand, then a significantly strong yarn will be formed when the twist initially inserted into the fibrous strand is subsequently removed. During this removal of the initially inserted twist the surface fibers helically wound against the surface of the core become even more highly tensioned and act to hold the core fibers tightly together. Moreover it will be seen that these outstanding results of the invention are achieved according to a method which forms the yarn of the invention continuously with structure very similar to that used for false twist texturizing. Thus, with the invention the false twister, which does not have in the interior thereof the usual cross pin, acts on the free fiber ends to helically wind the latter against the yarn core while at the same time imparting false twist to the latter through the action on the fibers.

The yarn which is produced according to the invention is characterized by a structure which has a continuous core of substantially parallel fibers which may be continuously or discontinuously covered with a covering or sheath of uniformly helically wound discontinuous fibers. Part of some of the core fibers are twisted with the outer covering or sheath fibers and part or most of the outer surface fibers are twisted with the core fibers. Thus the core will have alternating S and Z twist and this twist is distributed in such a way that at a part of the yarn core where the surface fibers are tightly wound the core has a twist in a direction opposite to the direction of winding of the surface fibers. On the other hand, at a region of the yarn where the surface fibers either are not so tightly wound or are completely lacking, the core will have a twist in a direction which is the same as the direction of winding of the surface fibers. The twist provided in this way in the core contributes to the strength of the yarn and provides a highly desirable liveliness in the yarn, and this liveliness, if released, would tend to undo the winding of the surface fibers. With the yarn of the invention there is a substantially uniform helix angle for the surface fibers with respect to the axis of the yarn.

Suitable raw materials for the yarns which can be provided according to the invention include all of the available synthetic and natural organic textile fibers and combinations thereof. Natural fibers which may be used include cotton, wool, silk, ramie, flax, jute, hemp, and the like. Suitable synthetic fibers include fibers of nylon, polyester, acrylic, polyethylene, polypropylene, polyvinyl chloride, cellulose acetate and viscose.

Furthermore, some fibers of inorganic matter such as glass and steel are also suitable.

The denier of the fibers used may vary over a wide range which may be from ½ to 100 depending upon the type of fiber employed and the requirements of the yarn. Typically, when using fibers such as nylon, polyester, rayon, cotton, wool, and other common textile fibers, the denier will range from 0.75 to 15.

Yarns produced according to the method of the present invention preferably are within but not limited to the range of 200 – 3,000 denier.

Thus, it is to be understood that various modifications and departures from the above may be made without departing from the claimed invention. In particular, many various configurations of twisters can be used, as long as such twisters are capable of acting upon the free fiber ends so as to helically wind the same against the core in the appropriate direction. In addition, the additional staple fibers deposited by the lickerin device can be different from the fibers of the drawn sliver in physical or chemical properties or both.

What is claimed is:

1. In a yarn manufacturing method, the steps of false twisting a yarn core which has a plurality of fibers projecting laterally from the surface of said core for first introducing a twist in a given direction into the yarn core and for then releasing the yarn core so that it tends to twist upon itself in a direction opposite to said given direction, and, while said twist in said given direction is introduced into the yarn core, winding said fibers projecting laterally from said core at least partly into engagement with the surface thereof in a direction opposite to said given direction, so that the thus wound fibers form surface fibers at the surface of said core maintaining said twist in said given direction therein, tensioning said fibers while they are wound around said core, and false-twisting said core solely by the tensioning of the fibers while they are wound around said core.

2. In a method as recited in claim 1 and including the step of longitudinally transporting said core simultaneously with the false twisting thereof.

3. In a method as recited in claim 2 and including the step of depositing said fibers on said core prior to the false twisting thereof.

4. In a method as recited in claim 3 and wherein said core is in the form of a sliver, and including the step of drawing said sliver prior to depositing of the fibers thereon.

5. In a method as recited in claim 1 and including the steps of longitudinally feeding said core through a rotary member which surrounds said core while rotating said rotary member around said core at a speed great enough to provide substantial slippage between said rotary member and said core, said rotary member having an internal diameter at least slightly greater than the diameter of said core and having an end surface toward which said core is fed and said end surface having a diameter small enough for frictionally engaging said fibers and helically winding them onto said core during longitudinal feeding thereof through said rotary member while false twisting of said core is provided by way of the action of said rotary member on said fibers.

6. In a yarn-manufacturing apparatus, feed means for feeding longitudinally along a predetermined path an elongated yarn core from the exterior surface of which a plurality of fibers project laterally, rotary tubular means surrounding said path for rotating about the latter and about a yarn core fed longitudinally therealong by said feed means, said rotary means having an upstream end surface toward which the yarn core is fed by said feed means and a downstream end surface away from which the yarn core is fed by said feed means, and said rotary tubular means having a hollow unobstructed interior throughout its length and having an inner uninterrupted surface of constant diameter, the internal constant diameter of said rotary means being small enough for said inner surface of said rotary tubular means to freely surround the yarn core with at least a slight clearance while said upstream end surface thereof is of a sufficiently small diameter to frictionally engage said fibers and wind the latter helically around and into engagement with said yarn core during longitudinal feeding thereof through said rotary means, and rotating means operatively connected to said rotary means for rotating the latter around said path and said core longitudinally fed therealong at a speed sufficiently high to provide substantial slippage between said rotary means and said core, while the latter is false twisted solely as a result of the action of said rotary means on said fibers.

7. The combination of claim 6 and wherein a depositing means is situated along said path upstream of said rotary means for depositing fibers on a core fed to said depositing means while the core with the fibers thereon continues to travel beyond said depositing means to said rotary means.

8. The combination of claim 6 and wherein said feed means includes feed rolls engaging said core downstream of said rotary means beyond said downstream end surface thereof and pulling on said core with a given tension while feeding the latter along said path through said rotary means.

9. The combination of claim 8 and wherein a winding means receives said core from said feed rolls for winding said core.

10. The combination of claim 8 and wherein said core is a sliver, and drawing means situated along said path upstream of said rotary means for drawing said sliver prior to arrival thereof at said rotary means.

11. The combination of claim 10 and wherein a depositing means is situated along said path between said drawing means and rotary means for depositing fibers onto said sliver to project laterally therefrom prior to reaching said rotary means.

12. The combination of claim 6 and wherein said upstream end surface of said rotary means has a relatively high coefficient of friction for engaging said fibers.

* * * * *